US010717314B2

(12) United States Patent
Somers

(10) Patent No.: US 10,717,314 B2
(45) Date of Patent: Jul. 21, 2020

(54) TACTUAL FINGER GRIP

(71) Applicant: Nancy Somers, Spokane, WA (US)

(72) Inventor: Nancy Somers, Spokane, WA (US)

( * ) Notice: Subject to any disclaimer, the term of this patent is extended or adjusted under 35 U.S.C. 154(b) by 0 days.

(21) Appl. No.: 16/041,803

(22) Filed: Jul. 22, 2018

(65) Prior Publication Data

US 2019/0054757 A1 Feb. 21, 2019

Related U.S. Application Data

(60) Provisional application No. 62/545,490, filed on Aug. 15, 2017.

(51) Int. Cl.
*B43K 23/00* (2006.01)
*B43K 23/012* (2006.01)
*B43K 23/008* (2006.01)

(52) U.S. Cl.
CPC ..... *B43K 23/012* (2013.01); *B43K 23/008* (2013.01)

(58) Field of Classification Search
CPC ..... B43K 23/00; B43K 23/008; B43K 23/012
USPC ..... 401/7, 8
See application file for complete search history.

(56) References Cited

U.S. PATENT DOCUMENTS

| | | | | |
|---|---|---|---|---|
| 794,329 | A | 7/1905 | Whitehouse | |
| 843,767 | A | 2/1907 | Plach | |
| 945,026 | A | 1/1910 | Faust | |
| 1,879,456 | A | 9/1932 | Parsons | |
| 2,379,624 | A | 5/1944 | Chisnell | |
| 3,887,286 | A * | 6/1975 | Bucey | B43K 7/00 401/7 |
| 4,167,347 | A | 9/1979 | Hoyle | |
| 4,526,547 | A | 7/1985 | Rusk | |
| 4,689,020 | A | 8/1987 | Rusk | |
| 4,832,604 | A | 5/1989 | Rusk | |
| 5,056,945 | A | 10/1991 | Klodt | |
| 5,135,226 | A | 8/1992 | Place | |
| 5,143,463 | A | 9/1992 | Pozil et al. | |

(Continued)

OTHER PUBLICATIONS

"Carpal Tunnel Syndrome", The Merck Manual of Medical Information Home Edition, pp. 336-337, Merck Research Laboratories, Merck & Co., Inc., Whitehouse Station, N.J., 1997.

*Primary Examiner* — David J Walczak
*Assistant Examiner* — Joshua R Wiljanen
(74) *Attorney, Agent, or Firm* — Nancy Somers

(57) ABSTRACT

A tactual finger grip device and method provides increased tactual and visual sensory awareness of finger pressure and alignment especially for the left-handed user. The grip device provides a conically shaped sleeve of resilient material for inserting and adjustably securing a hand-held implement, such as a writing implement. A plurality of raised surface projections circumferentially positioned about the grip device outer surface provide tactual friction with a user's fingers, enabling user tactile sensory awareness, causing the user to adaptably minimize the tactual friction by conforming fingers and hand to natural placement, when the user grasps the sleeve secured to the hand-held implement. The device provides visual indicia for the forefinger, index finger, and thumb placement forming a natural hand position. Alternatively, the raised surface projections positioned about the inner surface create tactual friction or pressure between the device and a wearer's received finger when pressure is applied to a surface.

18 Claims, 11 Drawing Sheets

(56) References Cited

U.S. PATENT DOCUMENTS

| | | | | |
|---|---|---|---|---|
| 5,662,423 | A * | 9/1997 | Walden | B43K 23/012 15/437 |
| 5,988,909 | A | 11/1999 | Luke, Jr. et al. | |
| 6,422,949 | B1 | 7/2002 | Byrne et al. | |
| 6,724,366 | B2 | 4/2004 | Crawford | |
| 7,476,043 | B1 * | 1/2009 | Rivas | B43K 7/00 401/195 |
| 7,744,137 | B2 | 6/2010 | Mazyck | |
| 2005/0232680 | A1 | 10/2005 | Schulken | |
| 2007/0118947 | A1 | 5/2007 | Lorenzo | |
| 2009/0007387 | A1 | 1/2009 | Laghi | |

* cited by examiner

TACTUAL FINGER GRIP

CROSS-REFERENCE TO RELATED APPLICATIONS

This application claims the benefit of U.S. Provisional Application Ser. No. 62/545,490 filed on Aug. 15, 2017.

STATEMENT REGARDING FEDERALLY SPONSORED RESEARCH OR DEVELOPMENT

"Not Applicable"

NAMES OF PARTIES TO JOINT RESEARCH

"Not Applicable"

INCORPORATION-BY-REFERENCE

"Not Applicable"

BACKGROUND OF THE INVENTION

This invention relates generally to finger grips for writing instruments and more particularly to devices promoting alignment of the left hand and fingers.

Many patents issued are directed to aids, sleeves, and grips for forming good writing habits for beginning writer's fingers and hand or for making the work of writing more comfortable for the adult writer's fingers and band. Many patents have issued are directed to devices for right hand writers and may include a similar device for the left hand. However, the left-handed writer encounters different alignment and pressure conditions as compared to those encountered by the right-handed writer.

U.S. Pat. No. 794,329 to Whitehouse is directed to a finger-guard for pencils for providing a rest for the thumb, first finger, and second finger to facilitate gliding motion of the hand from left to right and prevent writer's cramp as the fingers assume the position of holding an egg. The invention having cupped out depressions for correct finger positions at 120-degree finger placement separation and having solid ridges or guards causing discomfort if improper finger positions are used especially for beginners.

U.S. Pat. Appl. Pub. 2005/0232680 to Schulken is directed to a gripping aid for the purpose of proper positioning of the tripod fingers by thumb wrap-preventing rims. Correcting grasp or thumb position of young children and persons learning to write with a tripod grasp.

U.S. Pat. No. 1,879,456 to Parsons is directed to a writing instrument sleeve made of metal, wood, or cork with depressions to receive the thumb, first finger, and second finger.

U.S. Pat. No. 843,767 to Plach is directed to a penholder manufactured of wood, metal, or celluloid, provided with grooves corresponding to the thumb, forefinger, and middle finger and ridges between finger grooves, for holding the writing instrument in the correct position.

U.S. Pat. No. 4,526,547 to Rusk is directed to a writing aid and method of teaching using the writing aid for teaching a person how to hold writing instruments properly. The aid includes a body having a central boring to receive a writing instrument and three gripping surfaces positioned to receive the user's first (thumb) finger, second finger, and third finger, respectively.

U.S. Pat. No. 4,689,020 to Rusk describes the aid includes a body having a central boring to receive a writing instrument and three gripping surfaces positioned to receive the user's first (thumb) finger, second finger, and third finger, respectively. At least one surface having indicia means on color for instructing young children for finger placement. Alternatively, a mating material, such as Velcro, attached to one of the device finger surfaces and a glove means to be worn by the user with mateable material for gripping the device finger surface.

U.S. Pat. No. 4,832,604 to Rusk is directed to a writing aid for aiding the gripping of a hand-held writing instrument with three surfaces for receiving the first three fingers gripping the writing instrument having surfaces with indicia.

U.S. Pat. No. 945,026 to Faust is directed to a writing-position adjuster for correct finger placement while holding a writing instrument. The invention is a sleeve with a slidable spring clamp metal clip with a protrusion for exact forefinger placement.

U.S. Pat. No. 5,988,909 to Luke, Jr., et al. is directed to a writing instrument with ergonomic grip attached to one end of the pen tubular shaft intended to reduce strain on writer's fingers and wrist. The ergonomic grip having a contoured shape with two bulging portions and narrow waist between the portions, forming a dumbbell for cushioned finger placement. This is a pen and not a writing aid.

U.S. Pat. No. 5,143,463 to Pozil et al. is directed to a writing aid to reduce dynamic finger movements and increase full hand and arm action and benefits an arthritic individual. The writing aid comprises a generally pear-shaped body with a cylindrical hole running through the length of the writing instrument, with the smaller end of the aid intended to be nearer the writing tip of the instrument. First, second, and third concave depressions lie on lateral portions of the body, near the smaller end, spaced roughly 120 degrees apart, and are grasped by the thumb, index finger, and middle finger, respectfully. The device may be used for left handed writers.

U.S. Pat. No. 4,167,347 to Hoyle is directed to a writing instrument removable finger grip to promote proper use of writing instruments by professionals for extended periods of time without causing "writer's cramp" fatigue and avoiding perspiration while holding the instrument. The sleeve provides a triangular cross-sectional shape for finger placement. A plurality of ribs running the length of the bore of the grip firmly secure it to the writing device.

U.S. Pat. No. 5,056,945 to Klodt is directed to a writing instrument grip tube or sleeve, with a plurality of flexible interior ribs and a plurality of flexible exterior ribs, both extending the length of the grip. The grip provides the user a nonslick surface and allows for nonconstraining finger placement. The pressure of the writer's fingers on the exterior ribs provide a cushioning sensation to the writer's fingers. The ribs serve as channels which liquid sweat on skin of writer may be drained away.

The aforementioned finger placement patents having grooves, rests, and depressions for positional placement of fingers as well as the sleeve grip device patents do not teach increased tactual and visual sensory awareness of finger pressure and alignment especially for the left-handed user. The present invention grip device provides a conically shaped grip having a plurality of raised surface projections positioned proximal and circumferentially spaced about the outer surface to cause tactual friction or tactual pressure between the device and grasping fingers when a user applies pressure to a hand-held implement. Engaged user tactual sensory awareness allows the user to adaptably modify and correct finger pressure and placement toward a natural finger and hand position while grasping a hand-held implement.

The present device also provides visual indicia for the forefinger, index finger, and thumb placement forming a natural hand position.

U.S. Pat. No. 6,724,366 to Crawford is directed to a thumb actuated input device for the purpose of reducing stress and accommodating user finger length with variables defined by computer ergonomics experts. Computer ergonomics experts agree need to reduce stress and irritation associated with the repetitive motion injury while using a computer mouse includes a more relaxed and natural hand and wrist position. Carpal tunnel syndrome is aggravated where joints, tendons, and muscles become over flexed in unnatural positions.

Carpal tunnel syndrome is related to the compression of the median nerve through the wrist supplying the thumb side of the hand. Pain, numbness, tingling, swelling, muscle weakness or atrophy may be experienced in the first three fingers and thumb side of the hand by a compressed median nerve. *The Merck Manual of Medical Information*, pp. 336-337, Merck Research Laboratories, Merck & Co., Inc., Whitehouse Station, N.J., 1997.

U.S. Pat. No. 6,422,949 to Byrne, et al. provides alignment markers on golf balls for direction and force used on a golf club and contact between the club and ball as well as alignment indicia used with a putter and surface indicia on the golf ball. The alignment markers provide enhanced visual sensory perception of alignment on golf balls.

U.S. Pat. No. 5,135,226 to Place teaches a single-finger gripping device to provide a non-slip grip surface at the pivot point between the handle of a golf club and the golfer's hand using a conventional over grip. The grip teaches raised projections between the handle of the club and the golfer's index finger but does not teach hand or writing implement alignment.

U.S. Pat. Appl. Publication US2009/0007387 to Laghi custom grip teaches thermoforming of grip to holder's grasp. The device conforms to the hand grip and does not teach correction of hand positioning.

U.S. Pat. No. 2,379,624 to Chisnell is directed to a finger guard made of resilient material to be received over the end of the finger with a nonskid outer surface design to facilitate leafing papers or pages. Longitudinal ribs provide improved air ventilation for the finger on inner surface of the finger conical finger sleeve.

U.S. Pat. Appl. 2007/0118947 to Lorenzo is directed to a ventilated and swing away finger conical finger sleeve for ease in handling paper documents and includes a plurality of raised surface projections similar to conical finger sleeve available under brand name "Swingline" as "Rubber Finger Tips", stock number 54035, in various sizes including small, medium, and large.

U.S. Pat. No. 7,744,137 to Mazyck is directed to a page turning device finger sleeve with a pad affixed to the sleeve and includes a tacky outer surface configured to capture and lift a paper. The device is made of elastomeric material and worn on the finger of a user, operative to frictionally engage and move leaves of material.

The aforementioned grips and finger guard patents mentioned do not teach writing alignment or hand alignment awareness especially for the left-handed user. The present invention provides a grip having plurality of raised surface projections positioned about the inner surface creating tactual friction between the device and received finger when pressure is applied by the user's finger to a surface. The present grip device provides corrective alignment indicia for repeated motions of the fingers, hand, wrist, and arm.

There is a need for a grip device and method for providing increased tactual sensory awareness of finger and hand applied pressure and for providing increased visual sensory awareness of finger and hand alignment.

SUMMARY OF THE INVENTION

In accordance with the present invention a tactual finger grip device and method generally is provided for increasing tactual awareness of applied finger pressure and for increasing visual sensory awareness of finger and hand alignment.

The tactual finger grip device includes a conically shaped sleeve having a plurality of raised surface projections proximal and circumferentially spaced for enhancing tactual pressure or tactual frictional contact between the device and the user's fingers as the user contacts a surface. The tactual finger grip device provides visual indicia for increasing visual awareness of direction applied by the user's fingers. The tactual finger grip is preferably installed on a hand-held implement or worn on a finger. The hand-held implement may be a stylus, crayon, elongate writing implement, paintbrush, crochet needle, knitting needle, sewing needle, marker, eating utensil, knife, computer mouse, or the like. The tactual finger grip adjustably fits a hand-held implement or a finger such that the user should not feel constricting pressure, friction, or discomfort while the fingers and hand are at rest. However, the user will feel discomfort as constricting or tactual pressure or tactual friction when fingers and hand are engaged with a hand-held implement or applied to a surface. A method is provided for the tactual finger grip device in reducing applied pressure and improving alignment grasp of an elongate writing implement held by a left hand or right hand.

It is an object of the present invention to include a finger sleeve of resilient material having an outer surface and an inner surface defining an interior space therein, the finger sleeve being conically shaped and adapted to be received on a finger but instead will serve as a sleeve on a pen or pencil or hand-held implement. The finger sleeve having a first open end and an opposite curved second open end forming a longitudinal passage for inserting therethrough an elongate writing implement with a marking end. The curved second open end having a diameter less than the first open end diameter and adjustably secures to the elongate writing implement.

It is an object of the present invention to include a plurality of raised surface projections positioned about the outer surface, preferably over the entire surface of the finger sleeve. When the writer grasps the finger sleeve adjustably secured to the elongate writing implement some of the raised surface projections conform to the writer's grasp pressure and cause friction to the flesh of the fingers. The writer may perceptibly feel, tactually, a bumpy or uncomfortable sensation or friction from the raised projections when moving the arm, hand, wrist, and fingers in writing motions. This tactile or tactual awareness of pressure will assist the writer to modify grasp pressure or direction applied to the grip and to the writing implement. The conical shape of the grip allows the writer to repeatedly adjust grasp pressure and direction and develop and maintain awareness of his own hand, wrist, and finger placement without relying on one specific hand position.

It is an object of the present invention to include a finger sleeve of resilient material having an outer surface and an inner surface defining an interior space therein. The finger sleeve being conically shaped and adapted to be received on a finger of a wearer or user. The finger sleeve having a first open end and an opposite curved second open end, the curved second open end having a diameter less than the first open end diameter exposing a portion of a finger tip of the wearer. The open second end may only expose the fingertip to air exposure. In the present invention, the fingertip refers to the finger nail and finger pad regions of the finger. The exposed portion of the fingertip may include exposure of the finger pad so the wearer is able to perceive both the friction causing raised projections as well as the smooth contact surface.

Additionally, at least one surface of the finger sleeve, preferably the inner surface, has a plurality of raised projections positioned about the surface for enabling increased tactual pressure or friction between the finger and the raised projections. The wearer or user may find additional friction enhancement if both outer and inner surfaces have a plurality of raised projections. It is contemplated that the wearer may prefer the friction enhancement sensation to be lessened and this may be accomplished when the raised projections are located on the outer surface of the sleeve.

It is another object of the present invention to provide raised projections to grip or conform to the wearer and cause tactual friction or tactual pressure to the flesh of the finger when the wearer applies pressure to a contact surface, such as a keypad. The wearer may change the finger pressure applied to the contact surface thereby changing the tactual friction or tactual pressure received from the raised projections. The wearer may change the finger direction applied to the contact surface thereby changing the tactual friction or tactual pressure received from the tactual finger grip to the wearer's finger. The present invention enhances tactile perception, perception that is identified by touch, and allows the wearer to more readily identify and adjust the use patterns of hand, finger, and wrist for modifying and rectifying behavior patterns or overuse of muscles, tendons, or the median nerve under the transverse carpal ligament.

Another object of the present invention is to provide a tactual finger grip where the plurality of raised projections are nodules of circular, conical, hemispherical, elliptical, or cylindrical shape. The tactual finger grip material should conform to the applied pressure and then resume its original form. Preferred resilient materials include flexible, elastic material, such as a plastic, rubber, silicone, thermoplastic, polymeric material, or urethane material. Preferably the raised projections and the finger sleeve are constructed of the same material.

It is an object of the present invention to provide a first alignment indicia with a segment substantially extending the length of the finger sleeve. The first alignment segment longitudinally extends from the first open end to the curved second open end on the finger sleeve, the finger sleeve is then adjustably secured to a writing implement. When the writer grasps the tactual finger grip and writing implement, the first alignment indicia provides the writer a visual straight line upon which to place the forefinger on the tactual finger grip.

It is an object of the present invention to provide a second direction alignment indicia, located at the second open end of the finger sleeve, indicates direction including a dot, a diamond, or an arrow, or the like. The second alignment indicia is placed at the end of the first alignment indicia at the fingertip area. In a preferable embodiment, the forefinger is placed on the first alignment indicia and pressure is applied in the direction of the second alignment indicia.

It is an object of the present invention is to provide third alignment circumferential indicia on the finger sleeve and perpendicular to the first alignment segment, located approximately ⅔ to ¾ the length of the finger sleeve segment from the first open end. When the writer grasps the tactual finger grip and writing implement, the first alignment indicia provides the writer a visual straight line upon which to place the forefinger, the second alignment indicia provides a direction in which to apply pressure, and the third alignment indicia defines a lower region for thumb placement.

Yet another object of the present invention is to use the third alignment circumferential indicial for aligning the fingers, hand and wrist when the tactual finger grip is worn on the user's forefinger or index finger. When the hand is held in a naturally relaxed position, the first, second, and third alignment indicia form a straight plane and a visual intersection to align the forefinger, index finger, and fourth finger for increasing visual perception of overextended or unnatural finger positions. It is contemplated that more than one circumferential segment may be required to align the hand, finger, and wrist positions.

It is an object of the present invention to provide increased tactual and visual range awareness of direction, motion, and pressure applied by the wrist, hand, and fingers, and a method for modifying writing alignment behavior patterns or overuse of muscles, tendons, or the median nerve under the transverse carpal ligament.

It is another object of the present invention is to provide thumb placement alignment indicia composed of a rectangle on the sleeve. The rectangle long edge, extends from the first alignment indicia at the first open end of the finger sleeve to substantially the curved second open end of the finger sleeve, at an angle ranging between 5-25 degrees. The width of the rectangle is substantially the width of the wearer's thumb. The rectangle will be placed to the right of the first indicia segment for the forefinger placement for a left-handed user. The rectangle will be placed to the left of the first indicia segment for the forefinger placement for a right-handed user. This rectangular thumb alignment indicia is preferably placed on a tactual finger grip used on a hand-held implement, but it is contemplated to be used on a tactual finger grip worn on a finger. Preferably the writer will adjust the forefinger on the first alignment indicia and thumb in the rectangle alignment indicia while holding a writing implement to a natural angle, preferably and angle ranging between 5-15 degrees. This configuration will provide the writer a natural hand position for holding a writing implement. The angle formed by forefinger and thumb is approximately 30 degrees when the hand is in a flat relaxed position. Some writers prefer to curl the fourth and fifth fingers while others keep all fingers in a straight position. There are many references to both hand styles being correct. The writer should find the most comfortable position and use the hand, wrist, and finger muscles to support the placement.

It is a still further object of the present invention to provide visible alignment indicia where the preferred color of indicia segments and alignment marks is red. The indicia may be formed with ink or tape. The alignment indicia may have a smooth surface or projections about the surface. The indicia may be constructed of the resilient grip material.

In accordance with an embodiment of the present invention, a method generally is provided for using a tactual finger grip aid to adjust finger pressure and direction. Preferably a writer grasps the tactual finger grip secured to an elongate writing implement.

The first step of the method is to provide a tactual finger grip device. The device includes a finger sleeve of resilient material having a conical shape with an inner surface and an outer surface and an interior portion for adaptably receiving a finger therein. The first open end of the finger sleeve together with the opposite a curved second open end form a longitudinal passage for inserting and for receiving there through an elongate writing implement and exposing the marking end of the elongate writing implement, preferably in proximity with the smaller second open end. Forming a finger grip occurs by securing and adjusting the second curved open end of the finger sleeve on the elongate writing implement.

The second step of the method is to provide the outer surface of the finger sleeve with a plurality of raised projections for enhancing tactual friction with the writer's fingers upon grasping, when the writer grasps the elongate writing implement.

The third step of the method is placing the combination of the tactual finger grip secured upon the elongate writing implement within the grasp of the writer's hand such that the thumb, index finger, and third finger hold the finger sleeve surrounding the elongate writing implement therein. Grasping the tactual finger grip device and writing implement with the writer's fingers and hand pressure; such that the pressure from the writer's thumb, forefinger, and third finger forces the writing implement to tangibly compress some of the raised projections on the finger sleeve into the flesh of the fingers; thereby forcing tactual pressure unto the writer's forefinger, thumb, and third finger.

The fourth step of the method is adjusting and aligning the forefinger on the first alignment indicia in the direction of the second arrow alignment indicia and adjusting the thumb in the alignment block indicia until the forefinger and thumb form a natural angle hand position while grasping the elongate writing implement. Then moving an arm with the writing hand and fingers toward a sheet of paper until the elongate writing implement marking end contacts the paper, and moving the arm, hand, and fingers in motions which describe alphabetical characters to cause the elongate writing implement marking end to mark the paper. Preferably the forefinger on the grip will direct the motion and the thumb on the grip will provide pressure on the writing implement when written characters mark the paper.

The fifth step of the method is changing or decreasing the writer's finger and hand grasp pressure applied on the elongate writing implement thereby decreasing the tactual friction received from some of the raised projections on the tactual finger grip device. This step will be repeated as the writer manipulates the writing implement to reduce grasp pressure while forming characters on the paper.

The method further includes changing the writer's finger and hand direction or movement applied on the elongate writing implement thereby changing the tactual friction received from some of the raised projections on the tactual finger grip device; while further moving the hand in motions which describe alphabetical characters to cause the elongate writing implement marking end to mark the paper. This step will be repeated as the writer adjusts placement and position where preferably the arm, hand, and fingers will form a natural straight alignment without significant curl of fingers or wrist.

It is an object of this invention to provide temporary aid by enhancing tactual and visual sensory perception for correcting pressure and placement behavior patterns to form a natural and relaxed hand position. In the standard writing positions, the right-handed writer grips the implement such that the elongate writing implement presses against the writer's forefinger and thumb, and to a lesser extent the index finger. The contact areas formed between the implement shaft and fingers should remain in a relaxed but straight alignment with a natural hand position and wrist. A writer holding a writing implement typically experiences motion of the elongate writing implement and marking end of the implement across the writing surface relative to the grasping fingers and hand. Right-handed writers are able to visually align immediately formed characters while pulling the hand directionally toward body. Left-handed writers tend to push or pressure the hand and fingers on the writing implement while forming characters traversing the paper surface. A left-handed writer often angles the arm, wrist, and hand to form a preferred angle with the writing surface instead of moving the angle of the writing surface to accommodate the writer. Unnatural hand positions for writing such as a fist grasp, "white-knuckling" finger clench, motions restricted to the fingertip area, a claw formed by angled wrist and arm positions, backhand and wrist positions, or the like, may be modified with repeated use of the tactual finger grip device as a temporary corrective aid providing pressure and alignment awareness, especially by left-handed writers.

One more object of the present invention is to provide finger alignment by securing and adjusting the first open end of the finger sleeve on the elongate writing implement in proximity to the elongate writing implement marking end. This would permit the writer to use the wide end of the conical sleeve to adjust applied pressure to the elongate writing implement.

Additionally, the hand-held implement may be of a various size and is preferably a pen or pencil. Alternatively, the hand-held implement may be a stylus, crayon, paintbrush, needle, marker, eating utensil, knife, or the like.

An advantageous arrangement provides wearing the tactual finger grip on a finger, especially the forefinger or index finger, and aligning the first four fingers with the first, second, and third alignment indicia thereby aligning the fingers, hand, and arm. Additionally, it is contemplated the visual alignment indicia enable the wearer to modify overextended or unnatural patterns of the hand, finger and wrist, or overuse of muscles, tendons, or the median nerve under the transverse carpal ligament by providing a visual intersection of forefinger, index finger, and fourth finger alignment when the hand is held in a naturally relaxed position. It is contemplated that a tactual finger grip sleeve appropriately sized and secured to a hand-held implement will cause alignment of fingers and reduction of applied pressure while using hand-held tools such as a screwdriver, a computer mouse, or grasping a hand-held instrument such as a tennis racket or violin and may prevent overuse of tendons and muscles. Therefore, it is contemplated the dimensions of the sleeve may be varied substantially to accommodate hand size or hand-held implement size without changing the function of the invention.

Additionally, the tactual finger grip may be adapted and received on a finger where the plurality of raised surface projections is positioned about the inner surface of the grip, the outer surface of the grip, or on both surfaces of the grip. The selection should be made by the wearer to suit his particular needs. When the wearer applies pressure to a contact surface, such as a keypad, the raised projections grip or conform to the wearer and cause friction to the fleshy parts of the finger. The wearer may change the finger pressure or direction applied to the contact surface thereby changing the tactual friction received from the raised projections.

Another advantageous arrangement provides any combination of the alignment indicia on the grip for improving visual perception of finger direction and motion. The writer or wearer may not require all five alignment indicia for alignment correction. Preferably the first, second, and third alignment indicia are included on the tactual finger grip when worn on the finger of a wearer. While the fourth alignment indicia may be necessary when alignment with fingers to hand and wrist are necessary. Preferably the first, second, third, and fifth alignment indicia are included on the tactual finger grip when used as a sleeve on an elongate writing implement. It is contemplated for commercial purposes that the tactual finger grip may be used reversibly, inside out, or have indicia on both inner and outer surfaces. It is contemplated for commercial purposes that the tactual finger grip device be of a variety of sizes and suitable for each user to select the variation best suited for the individual.

Finally, it is an object of the present invention, a tactual finger grip device, to reduce pressure applied to a surface by hand, fingers, wrist, and arm to only that stroking pressure required to complete a task such as writing a character or touching a keypad. It is and object of the present invention to promote use of a natural relaxed position of hand, fingers, wrist, elbow, and arm and increase awareness of finger placement and motion simultaneously by touch and visual sensory perception. The tactual finger grip device is useful temporary corrective aid for providing pressure and alignment awareness the fist grasp, unnatural claw hand and wrist positions, or backhand wrist and grasp. These simultaneous corrections of hand and finger placement and applied pressure may adjust behavior patterns or overuse of muscles, tendons, or the median nerve under the transverse carpal ligament.

These and other objects and features of the present invention will be apparent from the following detailed description taken with reference to the figures of the accompanying drawings, wherein like elements are denoted by like reference numerals.

BRIEF DESCRIPTION OF THE DRAWINGS

The advantages and features of the present invention will better understood by the following description when considered in conjunction with the accompanying drawings in which.

These and other objects and features of the present invention will be apparent from the following detailed description taken with reference to the figures of the accompanying drawings, wherein like elements are denoted by like reference numerals.

DETAILED DESCRIPTION OF THE INVENTION

Figure 1:
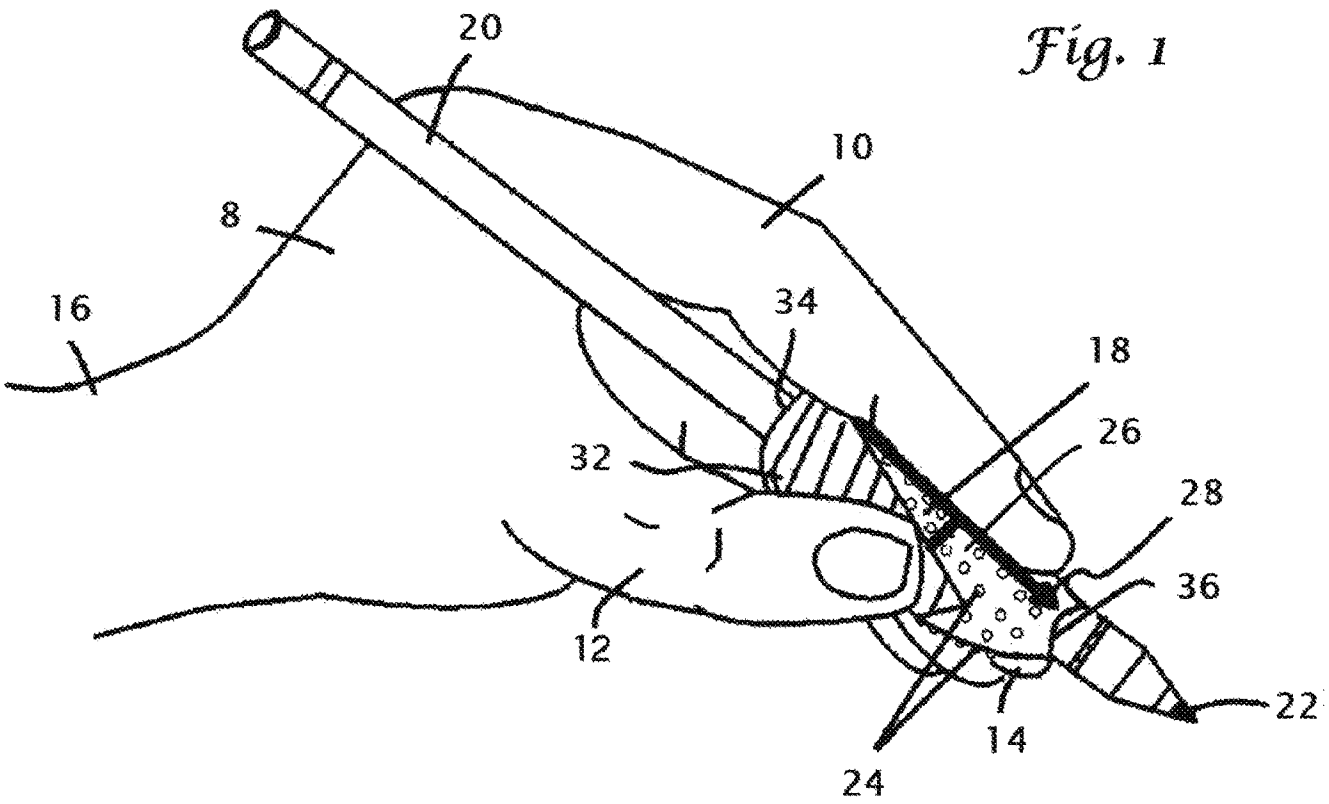
FIG. 1 is a perspective view the present invention as a tactual finger grip installed on a writing implement in use by a left-handed writer with a preferred hand position.

Shown in FIG. 1 is a perspective view of a left hand 8 gripping an elongate writing implement 20 using the tactual finger grip device 18 of the present invention. The tactual finger grip device 18 is located between the fingers and the writing implement. The preferred hand position is shown in FIG. 1 where the forefinger 10, thumb 12, and index finger 14 are aligned with the hand 8 and wrist 16. The figure is shown in use by a left-handed writer and it is noted in case of the right-handed writer, the grip tactual finger grip device 18 will be the mirror image of the grip tactual finger grip device 18 as shown.

The tactual finger grip 18 is a conically shaped finger grip of resilient material. The material of the finger grip is constructed of resilient, flexible, elastic material, such as a plastic, rubber, silicone, thermoplastic, polymeric material, or urethane material. The conical shaped finger grip, having an outer surface of grip 42 and an inner surface of grip 44, is adapted to be received by a finger or a hand-held implement, such as an elongate writing implement 20, and may be of various size depending on usage and preference of the user.

As illustrated in FIG. 1 the tactual finger grip device 18 having a first open end 34 and an opposite curved second open end 36 forming a longitudinal passage for inserting an elongate writing implement 20 with a marking end 22 and exposing the marking end 22. The curved second open end 36 has a diameter less than the first open end 34 diameter and adjustably secures the elongate writing implement 20.

A plurality of raised surface projections 24 positioned about the outer surface of grip 42 enable the holder to tactually sense a friction between a writer's fingers and some of the raised surface projections. It is preferred the plurality of raised surface projections 24 are nodules of circular, conical, hemispherical, elliptical, or cylindrical shape. The size of the tactual finger grip device 18 should be such that the friction created by the plurality of raised surface projections 24 is not significantly tactually sensed by the user in a relaxed position. Friction is significantly tactually sensed by the user's thumb 12, forefinger 10, or index finger 14 when the tactual finger grip device 18 is grasped or pressure is applied by the user.

Figure 3:
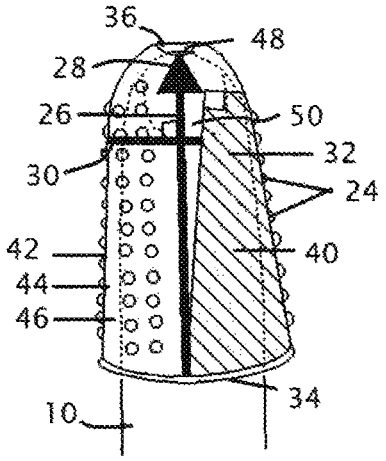
FIG. 3 is a cross section view illustrating the invention placed on a finger for left-hand users.

Visual alignment indicia increase the user's awareness of placement and direction of forefinger 10, thumb 12, and index finger 14 positions. The first alignment indicia longitudinal 26 segment longitudinally extends from the first open end 34 to the curved second open end 36. The second alignment indicia arrow 28 is located at the second open end 36 of the first alignment indicia longitudinal 26 including a dot, a diamond, an arrow, or the like. A third alignment indicia perpendicular 30 is located circumferentially about the finger grip approximately ⅔ to ¾ the length of the first alignment indicia longitudinal 26 segment and located at approximately the end of the fingernail when the tactual finger grip device 18 is installed on a finger as shown in FIG. 3. The third alignment indicia perpendicular 30 is perpendicular to the first alignment indicia longitudinal 26 segment. This indicia creates a lower quadrant on the tactual finger grip device 18 surface for which to place the thumb 12. The third alignment indicia perpendicular 30 increases user visual awareness of the forefinger 10 and index finger 14 alignment. A fourth alignment indicia, a rectangular thumb placement indicia 32, composed of a rectangular space for visually adjusting and aligning and placing the thumb 12 therein. The rectangle long edge extends at an angle to the first alignment indicia longitudinal 26, ranging between 5-25 degrees, preferably 5-15 degrees, or the natural angle 50, between thumb 12 and forefinger 10. The rectangular area 32 extends from the first open end 34 to substantially the curved second open end 36 of the tactual finger grip device 18. The rectangular area 32 provides the user a visual guide including the 5-25 degree natural angle 50 between the thumb 12 and forefinger 10. The indicia may be formed with ink, tape, or the same material as the tactual finger grip 18. The indicia may include a smooth surface or a continuation of the plurality of raised surface projections 24. The indicia may be any color that visually assist the user, preferably red in color.

Figure 2:
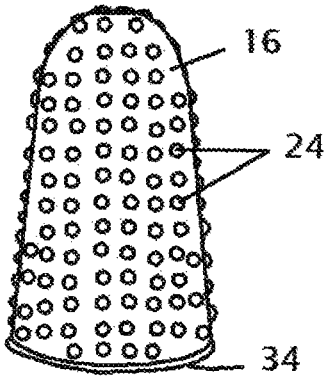
Fig. 2 prior art
FIG. 2 is a top view of a rubber sleeve fingertip (prior art).

With reference to FIG. 2 is a top view of a sleeve rubber fingertip 38 as known prior art. The rubber fingertip is conically shaped, constructed of resilient material having an outer surface 42 and an inner surface 44 defining an interior space 46 therein, and an open end 34 for receiving a finger. A plurality of raised surface projections 24 or ribs positioned about the outer surface 42 of the finger sleeve for enabling an increased friction between a finger and a piece of paper.

In another preferred embodiment as shown in FIG. 3 a cross section view illustrating the tactual finger grip device 18 invention placed on a left hand 8 forefinger 10. The conical shaped finger grip, having an outer surface 42 and an inner surface 44 and a defined interior space 46 therein, is adapted to be received on a finger. The tactual finger grip device 18 has a first open end 34 and an opposite curved second open end 36 exposing a portion of a fingertip 48 of the wearer. The tactual finger grip device 18 may be of various size depending on usage and preference of the user. The first alignment indicia longitudinal 26 segment, the second alignment indicia arrow 28, the third alignment indicia perpendicular 30, and fourth rectangular thumb placement indicia 32, as previously described, assist the user to visually become aware of and correct the direction and motion of the finger. A plurality of raised surface projections 24 are placed about the outer surface 42 of the tactual finger grip device 18 to increase tactile awareness of applied user pressure to a surface. The exposed fingertip 48 will tactually sense both the exerted pressure by the finger as well as the lesser pressure required to make contact with the surface by the friction-enhancing plurality of raised surface projections 24.

Figure 4:
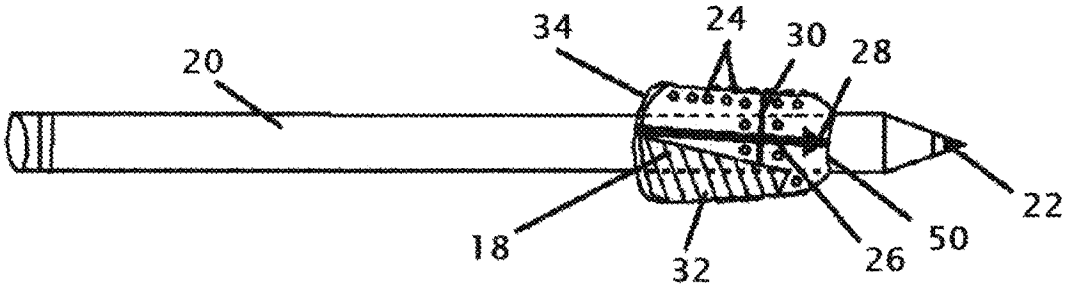
FIG. 4 is a perspective view of the invention as a grip writing aid attached to a writing implement.

As more clearly seen in FIG. 4 is a perspective view of the invention as a tactual finger grip device 18 writing aid attached to an elongate writing implement 20. The finger grip having a first open end 34 and an opposite curved second open end 36 forming a longitudinal passage for inserting an elongate writing implement 20 and exposing the marking end 22. The curved second open end 36 of the grip has a diameter less than the first open end 34 diameter and adjustably secures the elongate writing implement 20. A plurality of raised surface projections 24 positioned about the outer surface 42 of the finger grip enables increased friction between the writer's grasping forefinger 10 and thumb 12 and the elongate writing implement 20. The first alignment indicia longitudinal 26 segment, the second alignment indicia arrow 28, the third alignment indicia perpendicular 30, and fourth rectangular thumb placement indicia 32 providing a natural angle 50 guide, as previously described, assist the user to visually become aware of and correct the direction and motion of the forefinger 10 and thumb 12.

Figure 5:
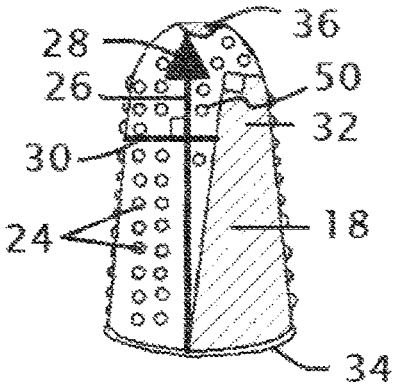
FIG. 5 is a top view illustrating the invention for left hand users.
Figure 6:
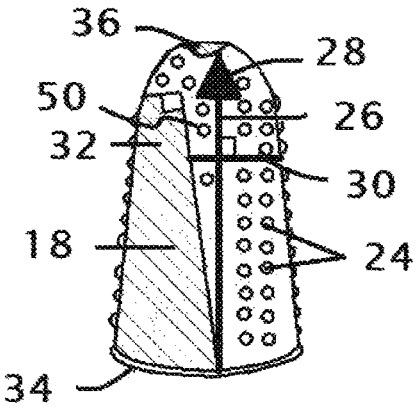
FIG. 6 is a top view illustrating the invention for right hand users.

As illustrated in FIGS. 5 & 6 are mirror image top views illustrating the invention. FIG. 5 is a top view for left hand 8 users; while FIG. 6 is a top view illustrating the invention for right hand users. The tactual finger grip device 18 may be appropriately fitted and used on any finger or hand-held implement. With reference to previous descriptions for FIGS. 1 & 3, the tactual finger grip device 18 having a first open end 34 and an opposite curved second open end 36 for inserting a hand-held implement or finger. The second open end 36 permits a proper fit and adjustably attaches to the inserted object. A plurality of raised surface projections 24 positioned about the outer surface 42 of the tactual finger grip device 18 enables increased friction between the writer's grasping fingers and the hand-held implement. As previously described, the first alignment indicia longitudinal 26 segment, the second alignment indicia arrow 28, the third alignment indicia perpendicular 30, and fourth rectangular thumb placement indicia 32 providing a natural angle 50 guide, assist the user to visually become aware of and correct the direction and motion of the forefinger 10, thumb 12, and index finger 14.

Figure 7:
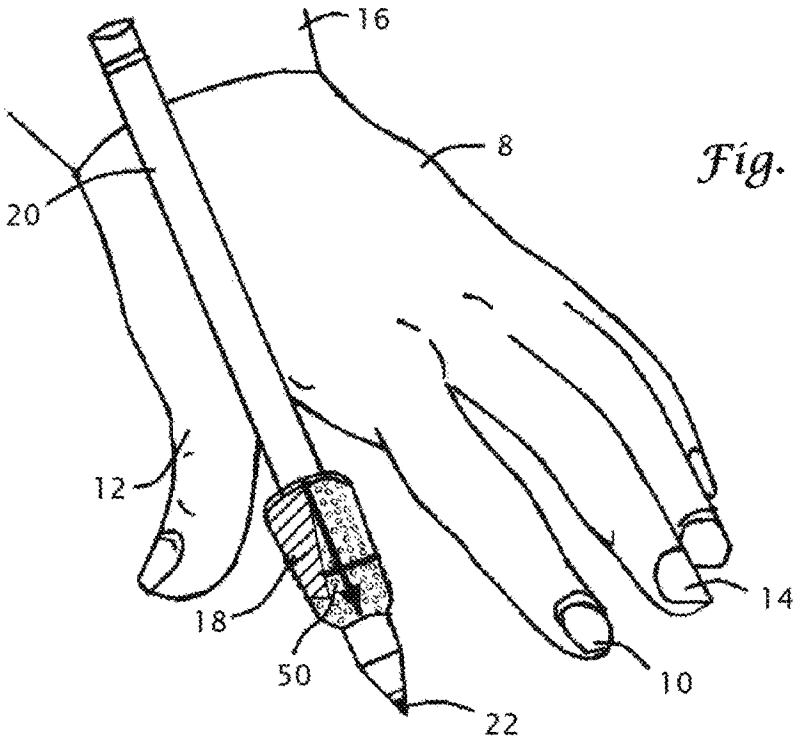
FIG. 7 is a perspective view of the grip invention correctly positioned in a writer's relaxed left hand.

FIG. 7 is a perspective view of the tactual finger grip device 18 invention correctly positioned with a relaxed left hand 8. The placement of the forefinger 10, thumb 12, and index finger 14 are in a naturally straight alignment with the left hand 8 and wrist 16. As previously described, the first alignment indicia longitudinal 26 segment, the second alignment indicia arrow 28, the third alignment indicia perpendicular 30, and fourth rectangular thumb placement indicia 32 providing a natural angle 50 guide reflect the finger and hand positions of the relaxed left hand 8.

Figure 8:
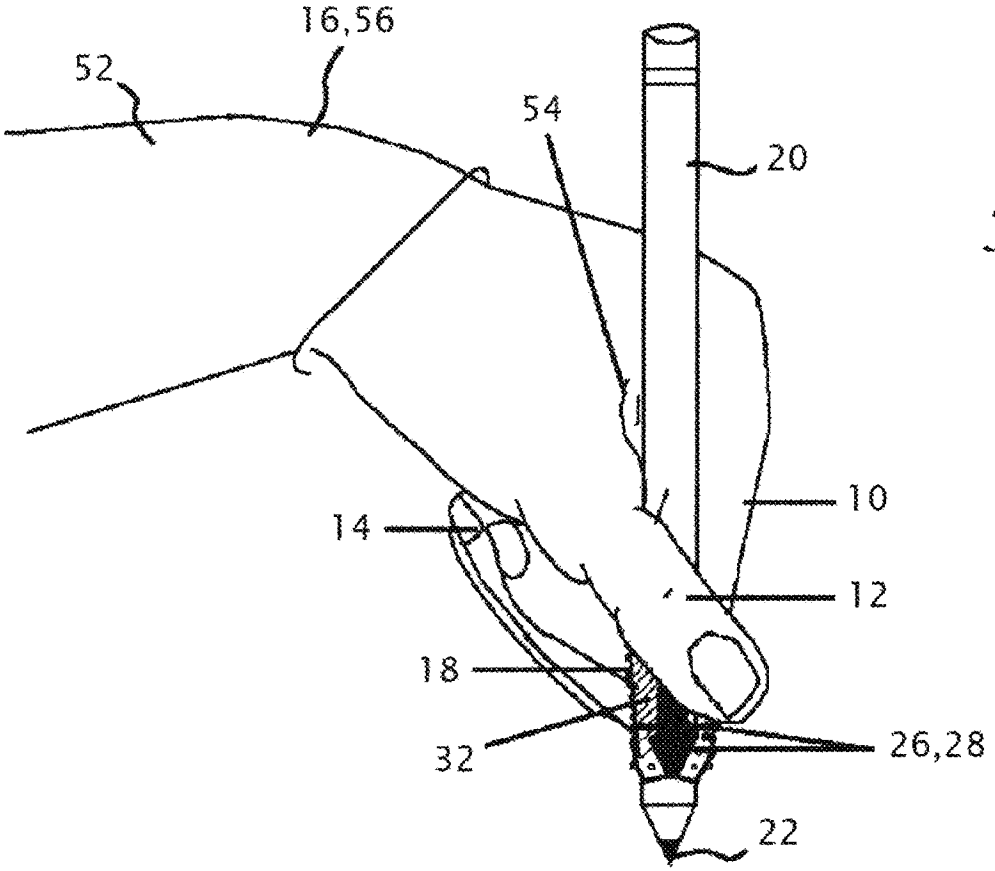
FIG. 8 is a perspective view of the grip invention in a left-handed writer's incorrect grasp claw position.

FIG. 8 is a perspective view of the tactual finger grip device 18 in a writer's left hand 8 positioned incorrectly, known as a writer's claw wrist 56, and incorrect left-hand position 8, known as a writer's fist grasp 54. The writer's claw wrist 56 position, formed by an angled left arm 52 and bent wrist 16 placement with the body, is a position used by left-handed persons attempting to maintain a perpendicular or bent hand to form characters on a writing surface with the elongate writing implement 20 marking end 22. The left-handed writer often uses a writer's fist grasp 54 by curling the fingers, especially the forefinger 10 and index finger 14, around the elongate writing implement 20 while using the thumb 12 to hold the elongate writing implement 20 in place or to form the written characters. As shown in FIG. 8, the tactual finger grip device 18 installed on the elongate writing implement 20 are held in the writer's claw wrist 56 and writer's fist grasp 54 positions, only the first alignment indicia longitudinal 26 segment and the second alignment indicia arrow 28 as perpendicular to the writing surface.

Figure 9:
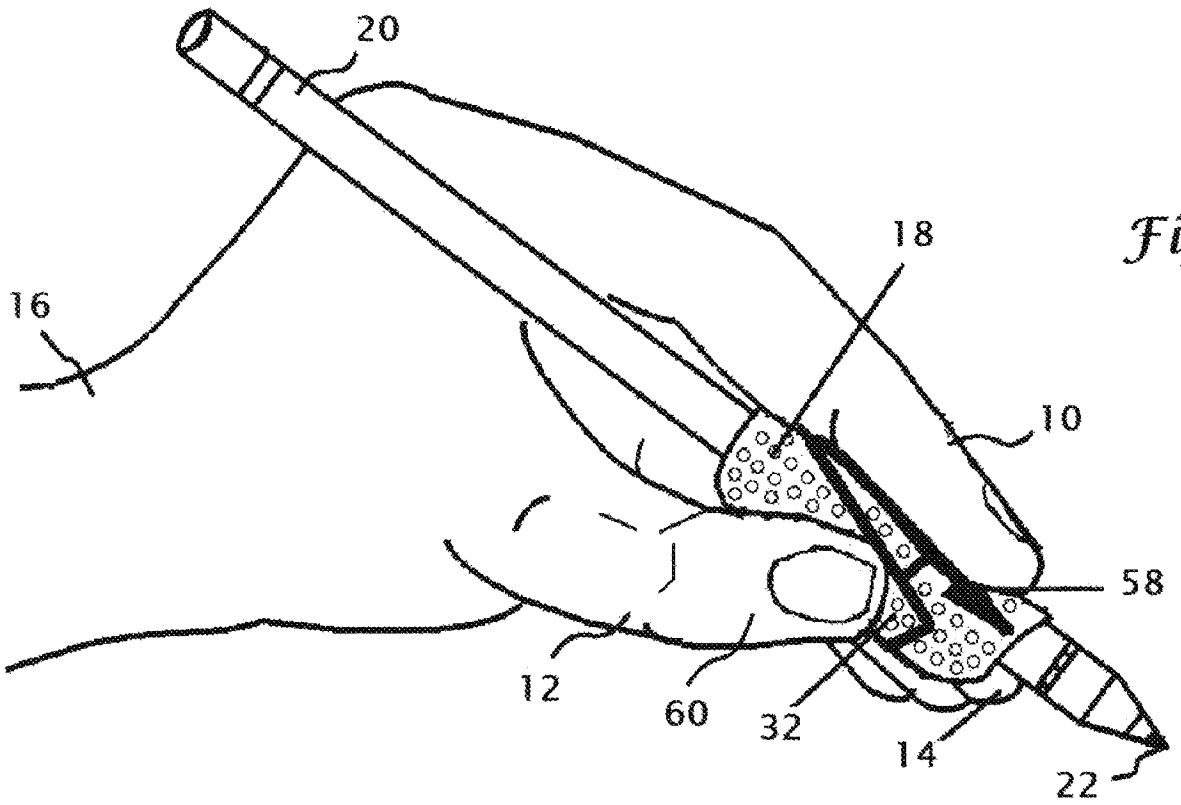
FIG. 9 is a perspective view illustrating the operation of the device when correctly grasped in a left hand.

As illustrated together with FIGS. 8 and 9 is shown an incorrect writer's left hand S placement in FIG. 8 and a correct writer's left hand 8 placement in FIG. 9. The adjusted positions for the left hand 8, wrist 16, and fingers using the tactual finger grip device 8 as a corrective alignment device is illustrated with FIGS. 8 and 9 together. The first alignment indicia longitudinal 26 segment and the second alignment indicia arrow 28 form the visual alignment for placement of the fleshy portion of the forefinger 10. The fourth rectangular thumb placement indicia 32 provides a visual alignment guide for placement of the fleshy part of the thumb 12, including the 5-25 degree natural angle 50 with the forefinger 10. Alternatively, the third alignment indicia perpendicular 30, without preference for a natural angle 50, provides a visual alignment guide for placement of the fleshy part of the thumb 12. The directional pressure applied by the aligned forefinger 58 and the reduced pressure applied by the aligned thumb 60 allows the entire hand and wrist to form a natural alignment when compared to the positioning in FIG. 8. The plurality of raised surface projections 24 cause increased tactile friction on the fleshy portions of the forefinger 10, thumb 12, and index finger 14 as the user increases applied grasping pressure on the elongate writing implement 20. The plurality of raised surface projections 24 also causes changes in tactile friction on the fleshy portions of the fingers as the user changes finger positions. This process or method includes iteratively adjusting finger placement and pressure depicted in FIG. 8 applied to the tactual finger grip device 18 and elongate writing implement 20 by sensing tactual friction and observing visual indicia until position and placement of left hand 8, wrist 16, and fingers 10, 12, 14 depicted in FIG. 1 or 9 are attained by the writer.

In another preferred embodiment FIG. 9 is a perspective view illustrating the operation of the tactual finger grip device 18 device when correctly grasped in a left hand 8. The fourth rectangular thumb placement indicia 32 is outlined and includes a plurality of raised surface projections 24 instead of filled or covered as in FIG. 1. Also, a variation of the size and placement of the tactual finger grip device 18 is illustrated in FIG. 9 in comparison with FIG. 1. For commercial purposes the tactual finger grip device 18 is made in a variety of different sizes for the user to select the tactual finger grip device 18 best suited for their own needs.

Figure 10:
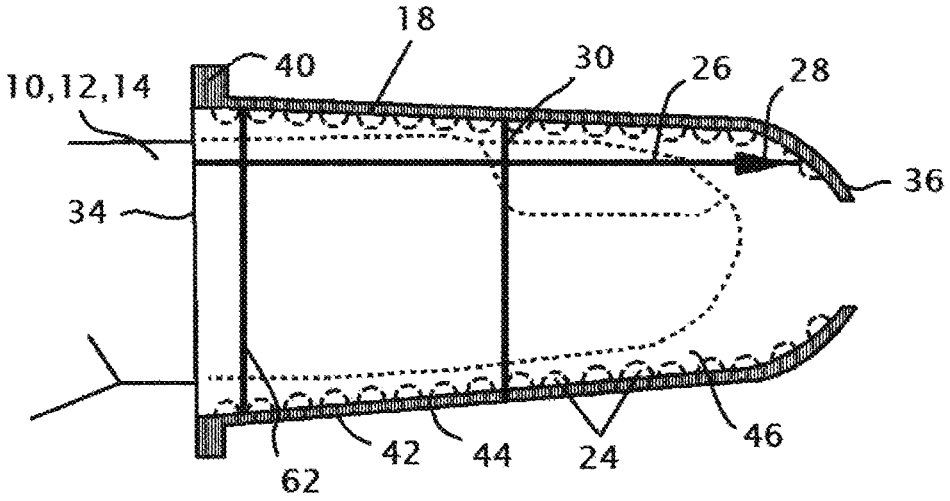
FIG. 10 is a longitudinal cross-section of the device placed on a user's finger with a plurality of raised surface projections about the inner surface and surface indicia on the outer surface.

FIG. 10 is shown a longitudinal cross-section of the tactual finger grip device 18 received on a finger with a plurality of raised surface projections 24 about the inner surface 44 and surface indicia on the outer surface 42. The plurality of raised surface projections 24 should not cause increased friction with the finger when the finger is at rest. The plurality of raised surface projections 24 cause increased friction on the finger when the finger applies pressure to a surface. Additionally, an alignment indicia, located circumferentially 62 about the finger grip at the first open end 34, provides visual alignment of finger knuckles and hand for the wearer. The plurality of raised surface projections 24 and visual alignment indicia, previously described, create increased tactual and visual awareness of unnoticed overuse, over exertion of pressure, or irregular movements when the finger applies pressure to a surface by the wearer.

Figure 11:
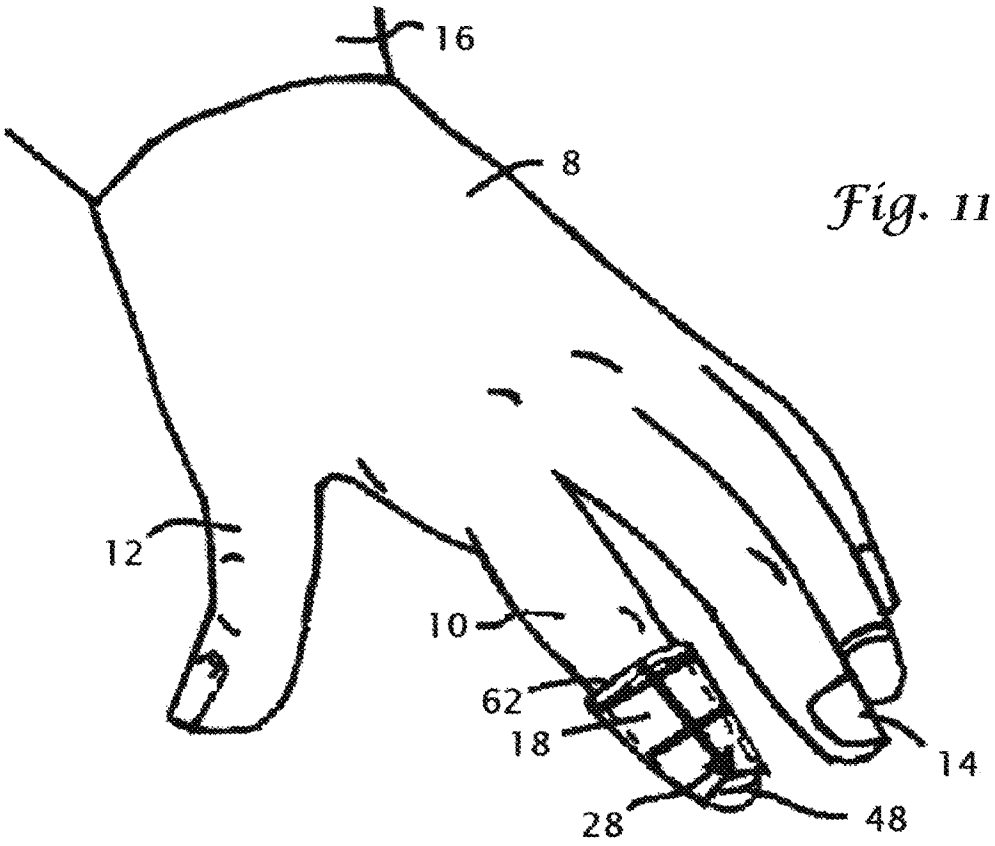
FIG. 11 is a perspective view of the device placed on a left-handed user's finger.

FIG. 11 is a perspective view of the tactual finger grip device 18 placed on a left-hand finger. As illustrated in FIGS. 10 and 11 together, the plurality of surface projections 24 is located about the inner surface 44 of the tactual finger grip device 18. As illustrated in FIGS. 3 and 11 together, the plurality of surface projections 24 is located about the outer surface 42 of the tactual finger grip device 18. For commercial purposes, the tactual finger grip device 18 may be reversible or used inside out. Additionally, the indicia may be on one or both outer surface 42 and inner surface 44. Alternatively, the tactual finger grip device 18 may include a plurality of surface projections 24 about both outer surface 42 and inner surface 44. The index finger 14 of a left hand 8 was chosen for illustrative purposes in FIG. 11; however, the tactual finger grip device 18 may be installed on any finger or either hand to suit the particular wearer.

Although there has been hereinabove described a tactual finger grip tactual finger grip device 18 and a method for corrective grasp and positioning for the left-handed writer in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A tactual finger grip device, comprising:

a finger sleeve of resilient material having an outer surface and an inner surface defining an interior space therein, the finger sleeve being conically shaped and adapted to be received on a finger; the finger sleeve having a first open end and an opposite curved second open end forming a longitudinal passage for inserting therethrough a hand-held implement having a hand-held portion and a working end portion; the curved second open end having a diameter less than the first open end diameter for adjustably securing the hand-held implement; a plurality of raised surface projections positioned circumferentially about the outer surface of the finger sleeve for causing increased tactual friction or tactual pressure between a user's fingers and some of the raised surface projections and for enabling user tactile sensory awareness for adaptably minimizing tactual friction leading the user to natural finger placement when the user grasps the finger sleeve adjustably secured to the hand-held implement.

2. The tactual finger grip device grip according to claim 1, wherein the material of the conical finger sleeve is constructed of resilient, flexible, elastic material, such as a plastic, rubber, silicone, thermoplastic, polymeric material, or urethane material.

3. The tactual finger grip device according to claim 2, wherein the plurality of raised projections are nodules of circular, conical, hemispherical, elliptical, or cylindrical shape.

4. The tactual finger grip device according to claim 1, further comprising a first alignment indicia segment longitudinally extending from the first open end to the curved second open end on the finger sleeve for providing the user a visual straight line upon which to place the forefinger on the tactual finger grip adjustably secured to the hand-held implement.

5. The tactual finger grip device according to claim 4, further comprising a second alignment indicia located at the curved second open end of the finger sleeve and upon the end of the first alignment indicia including a dot, a diamond, or an arrow.

6. The tactual finger grip device according to claim 5, further comprising a third alignment indicia located circumferentially about the finger sleeve approximately ⅔ to ¾ the length of the finger sleeve segment from the first open end and perpendicular to the first alignment segment, for aligning the forefinger and index finger and for defining distinct visual alignment regions for thumb placement on the lower quadrant region for receiving the fleshy part of the thumb on the tactual finger grip.

7. The tactual finger grip device according to claim 6, further comprising an alignment indicia composed of a rectangular space for visually adjusting and aligning the thumb therein; wherein the rectangle long edge extends at an angle to the first alignment indicia, preferably an angle ranging between 5-15 degrees, from the first open end of the finger sleeve to substantially the curved second open end of the finger sleeve.

8. The tactual finger grip device according to claim 7, wherein the color of indicia segments and alignment marks is red.

9. The tactual finger grip device according to claim 7, wherein alignment indicia may be formed with ink.

10. The tactual finger grip device according to claim 7, wherein alignment indicia may be formed with the same material as the finger sleeve.

11. The tactual finger grip device according to claim 1, wherein said hand-held implement is an elongate writing implement.

12. A tactual finger grip device comprising:

a finger sleeve of resilient material having an outer surface and an inner surface defining an interior space therein, the finger sleeve being conically shaped and adapted to be received on a finger of a wearer; the finger sleeve having a first open end and an opposite curved second open end, the curved second open end having a diameter less than the first open end diameter exposing a portion of a finger-tip of the wearer;

the inner surface of the finger sleeve having a plurality of raised projections positioned circumferentially about the surface for enabling increased tactual friction between the finger of the wearer and the raised projections when the wearer applies pressure to a contact surface and for enabling increased tactile perception of the wearer for adaptably adjusting finger, hand, and wrist positions.

13. The tactual finger grip device according to claim 12, wherein the plurality of raised projections is positioned circumferentially about the outer surface and the inner surface.

14. The tactual finger grip device according to claim 12, further comprising an alignment indicia located circumferentially about the finger sleeve at the first open end for defining the user a visual alignment of finger knuckles, and hand.

15. A method of tactually gripping an elongate writing implement, comprising:

providing a finger sleeve of resilient material having a conical shape with an inner surface and an outer surface and an interior portion for adaptably receiving a finger therein, having a plurality of raised projections positioned about the finger sleeve outer surface for enhancing tactual friction with the writer's fingers when the writer grasps an elongate writing implement with a marking end, having a first open end opposite a curved second open end forming a longitudinal passage for inserting and receiving therethrough the elongate writing implement and for exposing the elongate writing implement marking end;

forming a grip by securing and adjusting the second curved open end of the finger sleeve on the elongate writing implement;

placing the combination of the tactual finger grip adjustably secured to the elongate writing implement within a writer's grasp such that a writer's thumb, forefinger, and index finger hold the finger sleeve surrounding the elongate writing implement therein; and grasping with pressure the tactual finger grip device and writing implement such that the writer's thumb, forefinger, and index finger force the writing implement to compress some of the raised projections into the fleshy parts of the fingers; thereby forcing tactual pressure and friction into the writer's thumb, forefinger, and index finger;

moving an arm with the writing hand and fingers toward a sheet of paper until the elongate writing implement marking end contacts the paper;

moving the writing hand and fingers in motions which describe alphabetical characters to cause the elongate writing implement marking end to mark the paper;

changing the grasping pressure applied on the elongate writing implement thereby changing the tactual pressure and friction received from some of the raised projections on the tactual finger grip device until only the grasping pressure necessary to mark the paper is applied on the elongate writing implement; and adjusting and aligning visually the forefinger on the first alignment indicia with forefinger movement in the direction of the second alignment indicia;

adjusting and aligning visually the thumb in the rectangle alignment indicia for enabling a natural hand position and angle between forefinger and thumb, preferably an angle ranging between 5-15 degrees;

changing the writer's finger and hand direction or movement applied on the elongate writing implement thereby changing the tactual pressure and friction received from some of the raised projections on the tactual finger grip device while aligning visually the forefinger and thumb positions; and further moving the arm and hand while further aligning the fingers in motions which describe alphabetical characters to cause the elongate writing implement marking end to mark the paper until evenly aligned characters mark the paper.

16. The method of claim 15, wherein forming the grip further comprises securing and adjusting the second curved open end of the finger sleeve on the elongate writing implement in proximity to an elongate writing implement marking end.

17. The method of claim 15, wherein forming the grip further comprises securing and adjusting the first open end of the finger sleeve on the elongate writing implement in proximity to an elongate writing implement marking end.

18. A tactual finger grip device, comprising:

a sleeve of resilient material having an outer surface and an inner surface defining an interior space therein, the sleeve being sized and adapted to be received on a hand-held implement, a plurality of raised surface projection projections positioned circumferentially about the outer surface of the sleeve for enabling increased user sensory awareness of tactual friction or tactual pressure between the user's hand and some of the raised surface projections when the user grasps the sleeve adjustably secured to the hand-held implement; including a first alignment indicia segment longitudinally extending from the first open end to the second open end on the sleeve for providing the user a visual straight line upon which to place a finger, and a second alignment indicia in the form of a line extending at an angle preferably ranging between 5-15 degrees with the first alignment indicia located from the first open end to the second open end on the sleeve for providing the user a visual straight line upon which to place another finger or fingers for defining distinct visual alignment regions for forming a natural hand position of the fingers.

* * * * *